United States Patent [19]

Avery

[11] Patent Number: 4,970,970

[45] Date of Patent: Nov. 20, 1990

[54] DRYING AND BURNING INCINERATOR FOR TRASH

[75] Inventor: Alfred J. Avery, Flushing, Mich.

[73] Assignee: Avery Solid Waste Incineration Co., Flint, Mich.

[21] Appl. No.: 371,198

[22] Filed: Jun. 26, 1989

[51] Int. Cl.[5] ..... A47J 36/00

[52] U.S. Cl. ..... 110/246; 110/226; 110/216; 110/259; 110/166

[58] Field of Search ..... 110/226, 246, 216, 165 R, 110/166, 170, 259, 233; 432/118

[56] References Cited

U.S. PATENT DOCUMENTS

| | | | |
|---|---|---|---|
| 836,222 | 11/1906 | Smith | 110/246 |
| 1,491,894 | 4/1924 | Atkinson | 110/226 |
| 2,020,682 | 11/1935 | Granger | 110/226 |
| 2,577,659 | 12/1951 | Knipping | 110/226 |
| 3,357,382 | 12/1967 | Matteini | 110/246 |
| 4,094,633 | 6/1978 | Peterson et al. | 432/118 |
| 4,136,965 | 1/1979 | Sunnergren et al. | 432/118 |
| 4,274,344 | 6/1981 | Nider | 432/118 |
| 4,391,206 | 7/1983 | Matteini | 432/118 |
| 4,588,429 | 5/1986 | Hohman et al. | 432/118 |
| 4,639,216 | 1/1987 | Schnupp | 432/118 |

*Primary Examiner*—Edward G. Favors
*Assistant Examiner*—Denise L. Ferensic
*Attorney, Agent, or Firm*—Gifford, Groh, Sprinkle, Patmore and Sprinkle

[57] ABSTRACT

An incinerator for drying then cleanly burning trash. The incinerator includes an upper rotating trash drying tumbler for receiving and drying trash and a lower rotating trash burning tumbler interconnected to the upper tumbler for receiving dried trash therefrom. The lower rotating tumbler includes a meshed screen thereabout for complete combustion of the trash therein. The heat produced from the burning trash in the lower tumbler causes the drying of trash in the upper tumbler. A rotating fire tray is situated below the lower tumbler for collecting and reburning any material falling from the lower tumbler and for retaining combustible material for igniting the dried trash in the lower tumbler. When the interior temperature of the incinerator is high enough, the trash in the lower tumbler is self-ignited and heat produced from burning material in the fire tray is no longer necessary. Air exhausted from the drying and burning of the trash is filtered before being exhausted into the atmosphere.

23 Claims, 2 Drawing Sheets

DRYING AND BURNING INCINERATOR FOR TRASH

BACKGROUND OF THE INVENTION

I. Field of the Invention

The present invention relates generally to incinerators for burning trash. More particularly, the present invention relates to an incinerator which first dries then burns trash and can reburn trash not completely burned during the first burning cycle.

II. Description of the Relevant Art

In a world increasingly encumbered by trash, disposal problems are increasing. A variety of attempts have been made at overcoming the problem of trash.

A common attempt at disposing of trash has been to bury the trash in a land fill whereby hills are created where hills did not once exist. For some time this solution seemed ideal. However, we now know that such sites causes leaching of trash-related fluids into the water table, even when the land fill is lined to make it "sanitary".

In addition to this serious environmental problem, land fills have proven so workable in the short term that they are filling quickly. Current estimates are that at least one-third of presently operating land fills will shut down from being filled by the mid-1990's. Indeed, land fills have proven only a limited response to the problems of mounting trash.

The common alternative to burying trash in land fills is that of trash incineration. While certainly eliminating all or most of the burned trash, incineration as presently known has at least three disadvantages.

First, there is the problem of air pollution resulting from the incomplete incineration of trash. Most known incinerators do not operate efficiently enough or at a high enough heat to produce a complete burn.

Second, there is the requirement of the input of a fuel such as gas or oil to accomplish the burn. This not only adds to the air pollution problem, but creates a new problem with respect to using limited resource fuels thereby making some burns cost-prohibitive.

Third, there is the inability of presently-known incinerators to burn damp or wet trash, thus resulting in incomplete burning of trash or excessive air pollution from unburnable trash.

Accordingly, the prior approaches to solving the problem of providing effective or convenient methods of disposing of trash, particularly through incineration, have failed.

SUMMARY OF THE PRESENT INVENTION

The present invention provides an incinerator for drying and cleanly burning trash. The incinerator includes an upper rotating trash drying tumbler for receiving and drying trash and a lower rotating trash burning tumbler interconnected to the upper tumbler for receiving dried trash therefrom. Both tumblers are essentially drum-shaped.

The upper tumbler includes in its interior axially provided scoops and disks fitted radially between the scoops for tumbling and directing trash from the tumbler's inlet end to the tumbler's outlet end. The inlet end is elevated relative to its outlet end to thereby rely on the combination of gravity, scoops and disks for moving the trash through.

The lower tumbler includes in its interior axially provided trusses for tumbling dried waste delivered from the outlet of the upper tumbler. This tumbling action provides an even burn of the trash tumbled therein. The lower tumbler includes a dried trash inlet end for receiving trash from the outlet of the upper tumbler and a non-burnable or ash outlet end. The trash inlet end is elevated slightly relative to the outlet end.

To assure complete combustion, the peripheral wall of the lower tumbler is composed of a metal mesh or an expanded or perforated metal.

Actual burning is accomplished in the lower tumbler. The heat generated from the lower tumbler dries the trash disposed within the upper tumbler.

Situated below the lower tumbler is a rotating fire tray that serves the dual function of receiving unburned trash falling from the lower tumbler and acting as a tray for combustible materials for igniting the trash in the lower tumbler as required. The combustible materials may either be wood or woodchips, coal or natural gas. When the interior temperature of the incinerator becomes high enough, heat from the fire tray is no longer necessary as the trash received in the lower tumbler is self-ignited. Accordingly, the burning material of the fire tray acts as "starter heat".

Each of the two tumblers and the fire tray is disposed within a housing structure preferably composed of fire block walls and a cement roof.

The housing structure includes an inlet for trash, an outlet for ash, an inlet for oxygen, and an exhaust. The oxygen may either be forced in or may be taken in by the draw created by combustion. Heated gases move from the fire tray and lower tumbler into and through the upper tumbler to aid in the removal and carrying away therefrom of moisture.

Exhaust gases are "scrubbed" in a detoxifier to remove impurities and noxious elements before their release into the atmosphere.

Other advantages and features of the present invention will become more apparent from the following detailed description when read in conjunction with the accompanying drawing.

BRIEF DESCRIPTION OF THE DRAWINGS

The present invention will be more fully understood by reference to the following detailed description of the preferred embodiments of the present invention when read in conjunction with the accompanying drawing, in which like reference characters refer to like parts throughout the views, and in which.

DETAILED DESCRIPTION OF THE PREFERRED EMBODIMENT OF THE PRESENT INVENTION

Figure 1:
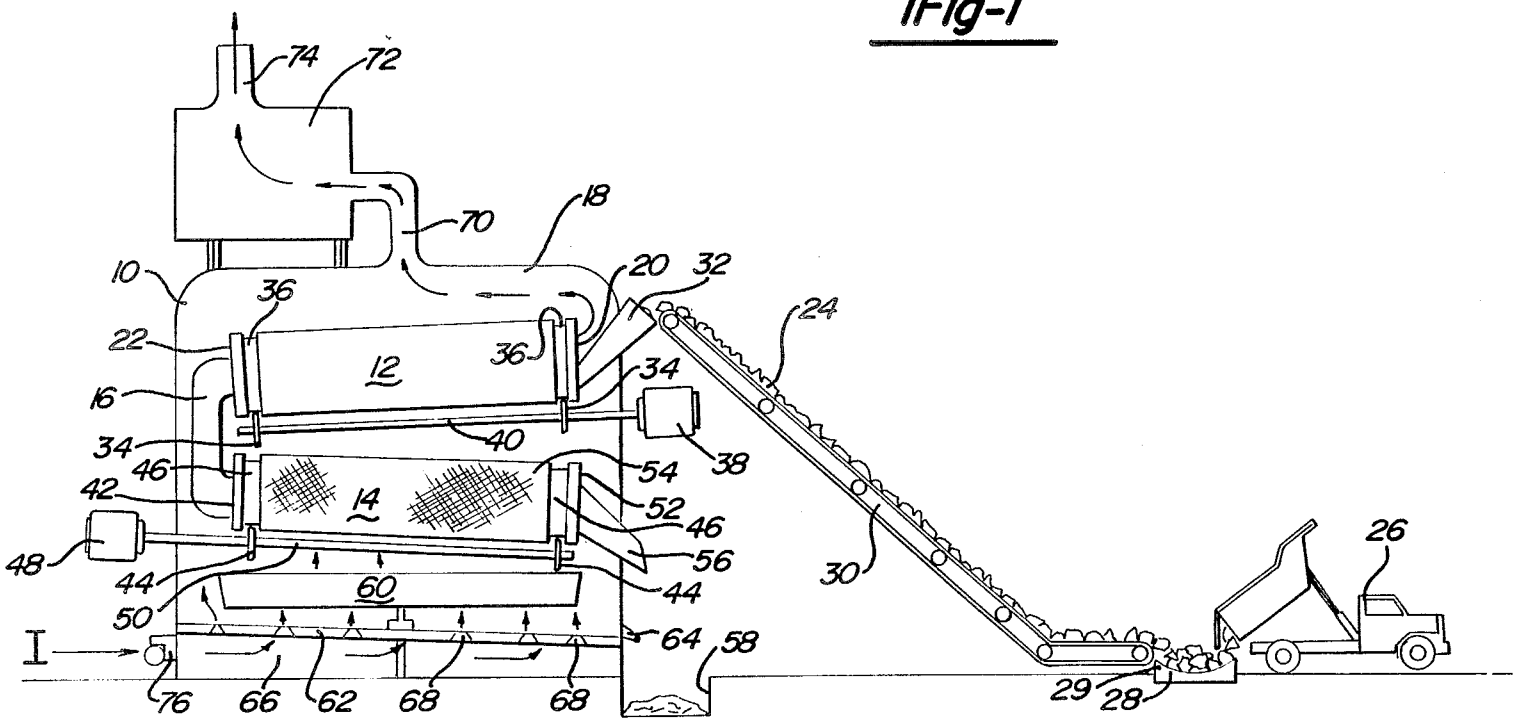
FIG. 1 is a raised elevational side view of the incinerator of the present invention illustrated in cross-section.

The drawing discloses the preferred embodiment of the present invention. While the configuration according to the illustrated embodiment is preferred, it is envisioned that alternate configurations of the present invention may be adopted without deviating from the invention as portrayed. The preferred embodiments are discussed hereafter.

Referring to FIG. 1, a raised elevational side view of the incinerator of the present invention is illustrated. The incinerator comprises a housing 10 within which is housed an upper rotating trash drying tumbler 12 interconnected to a lower rotating trash burning tumbler 14 via a trash transfer pipe 16. The housing 10 is preferably composed of a cement or firebrick. A roof 18 encloses the top of the housing 10. The roof 18 should preferably be composed of a removable cement slab.

The upper tumbler 12 includes a trash inlet end 20 and a dried trash outlet end 22. A combination of trash 24 (comprising, for example, general garbage including hard-to-dispose-of items) is delivered by a delivery vehicle 26 to a tipping floor 28 situated approximately at the base of a conveyor 30. The tipping floor 28 tips on its tip pivots 29 to dispose the trash 24 onto the conveyor 30. The conveyor 30 may be driven by motors (not shown) or by steam-powered engines (not shown) which take steam from a boiler system (not shown) established in association with the burning of trash according to the present invention.

The trash 24 is delivered up the conveyor 30 until reaching an inlet funnel 32 which guides the trash 24 therethrough and into the upper tumbler 12 through the trash inlet end 20. Once inside the upper tumbler 12, the trash 24 is tumbled about by the tumbling action of the tumbler 12. The tumbler 12 is rotated by four upper rollers 34 which frictionally engage a pair of upper roller channels 36 defined peripherally about the tumbler 12. The channels 36 may instead comprise a pair of channel tracks (not shown) welded to each end of the tumbler 12. At least two of the upper rollers 34 are driven by an upper motor 38 which drives the upper roller 34 via an upper drive shaft 40. The tumbler 12 may be driven at variable speeds.

While the driving source of the tumbler 12 is illustrated here as being a motor 38, it should be understood that in lieu of a motor, a steam-powered engine (not shown) may be alternatively employed as suggested above with respect to the conveyor 30. This approach would make the mechanical movements of the tumbler 12 self-sufficient from steam produced by burning.

In lieu of the motor driven upper rollers 34 as illustrated, the rollers 34 may instead only act as bearings to supply support instead of driving, whereas the upper tumbler 12 may be driven instead by chains (not shown) engaging the motor 38 and the tumbler 12. When used as bearings, water may be distributed thereover for cooling.

The upper tumbler 12 may be of any workable size, although a suggested size is eight feet in diameter by twenty feet in length. The tumbler 12 should preferably be composed of stainless steel or a similar grade steel.

The upper tumbler 12 dries the trash 24 disposed therein. Drying is accomplished by heating from below as will be described hereafter. Ideally, the tumbler 12 should be preheated to a temperature of 1000° fahrenheit before the trash 24 is disposed therein. This preheating aspect offers the significant advantage of drying even very wet or damp trash 24, such wetness often compromising the efficiency of known incinerators.

Once the trash 24 is dried, it exits the upper tumbler 12 at the outlet end 22 and enters an inlet end 42 of the lower tumbler 14 via the trash transfer pipe 16.

The lower tumbler 14 is substantially the same as the upper tumbler 12 in size and in its method of driving. A set of four lower rollers 44 frictionally engage a pair of lower roller channels 46 defined peripherally about the tumbler 14. At least two of the lower rollers 44 are driven by a lower motor 48 via a lower drive shaft 50. The tumbler 14 may be driven at variable speeds.

Again, as with the upper tumbler 12, the lower tumbler 14 may be steam or chain driven.

The inlet end 42 is elevated slightly with respect to an outlet end 52. The lower tumbler 14 comprises a peripheral wall 54 composed of a metal mesh or expanded or perforated stainless steel. This construction allows for substantially complete combustion of the trash 24 disposed within the tumbler 14.

The trash 24 disposed within the lower tumbler 14 is burned therein, creating heat necessary for the drying process undertaken in the upper tumbler 12. As the trash 24 is burned within the lower tumbler 14, the tumbling action of the tumbler 14 causes a complete combustion. Some non-combustible material and ash falls through the apertures in the wall 54 of the lower tumbler 14 while some is directed toward the burned trash outlet end 52 and out of the tumbler 14 via a burned trash chute 56. The remnants falling through the chute 56 are gravitationallY deposited in a pit 58.

The lower tumbler 14 rotates at a preselected speed, although the preferred speed has limits of being slow enough to allow thorough burning, yet fast enough to prevent the trash 24 from piling up or caking.

Situated beneath the lower tumbler 14 is a rotating fire tray 60. The fire tray 60 serves the dual purpose of catching material falling from the lower tumbler 14 and of providing a place for combustible materials for ignition of the trash 24 within the lower tumbler 14 as may be required. While the size of the fire tray 60 may be adapted as need requires, a suggested size is two feet deep and twenty feet in diameter. The sides are preferably composed of 3/16" hot rolled steel.

Beneath the fire tray 60 is provided an ash floor 62 onto which ash and unburned trash 24 may fall or be disposed. The floor 62 is disposed at a slight incline down toward an ash dump 64 through which disposed ash bypasses into the pit 58.

To facilitate combustion, oxygen-rich air enters the housing 10 approximately at the entrance point indicated by arrow "I". The air enters a sub-ash floor cavity 66 and passes up through any one of a plurality of apertures 68 defined in the ash floor 62. The air then aids in combustion being conducted both in the fire tray 60 and the lower tumbler 14. Now heated gas, some of the air passes from the lower tumbler 14 into the upper tumbler 12 by way of trash transfer pipe 16.. The upward route of the gas is prompted by its light weight relative to the cooler, unheated air, and an upward draft is thereby created within the housing 10. The gas, while passing through the upper tumbler 12, collects moisture from the trash being dried within. The gas then exits the upper tumbler 12 at the inlet end 20.

Upon reaching the underside of the roof 18, the heated exhaust gas is siphoned into an exhaust flue 70 for entrance into a flue gas washer 72. The washer 72 may be a scrubber device commonly used in electricity-producing powerhouses fired by coal. Once filtered, the exhaust gas escapes into the atmosphere by way of a stack 74.

To assist as required in firing the fire tray 60, an auxiliary fuel burner 76 is provided for providing fuel for combustion.

Figure 2:
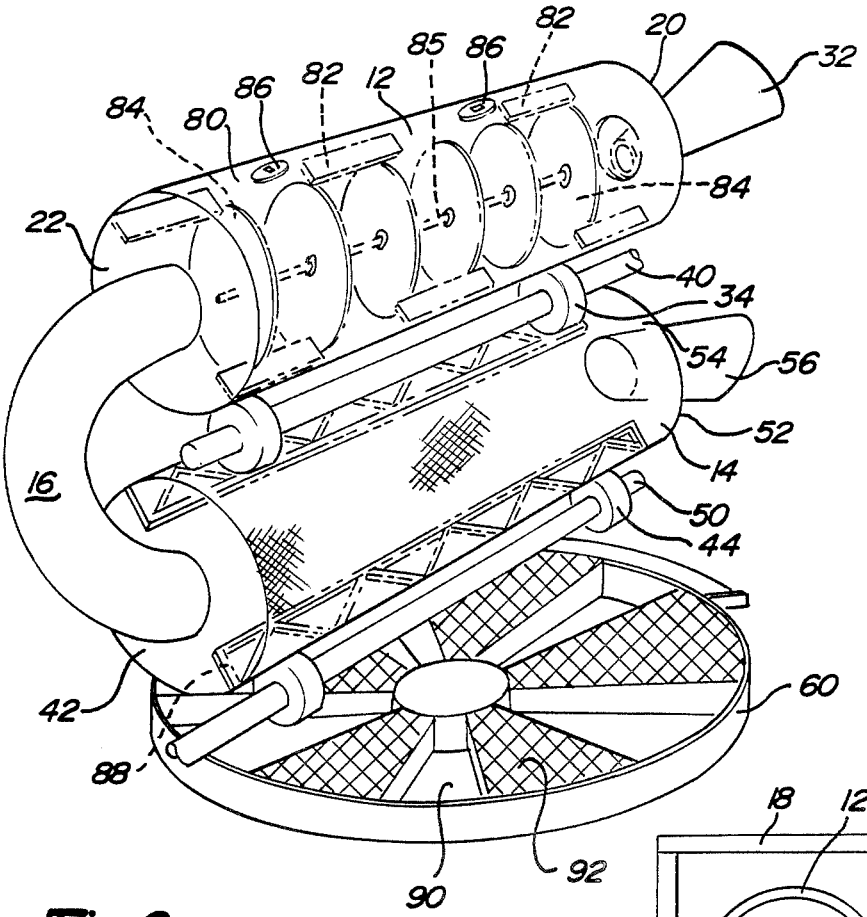
FIG. 2 is a perspective view illustrating the principal elements of the present invention in partial cross-section.

With reference to FIG. 2, a perspective view of the main elements of the present invention is illustrated.

The upper tumbler 12 is shown to expose its internal components. The tumbler 12 includes a peripheral wall 80 and the inlet end 20 and the outlet end 22. Within the tumbler 12 and axially mounted to the inside of the wall 80 are a plurality of scoops 82. Situated radially between the scoops 82 are a plurality of disks 84.

The rotating combination of the scoops 82 and the disks 84 cause both uniform drying of the trash and the travel of the trash toward the outlet end 22. The speed of rotation of the tumbler 12 may be varied as required. In addition, the pitch of the disks 84 may be altered by rotatable adjustment of a pitch shaft 85 to vary the amount of time the trash remains in the tumbler 12. The amount of time is naturally based on the wetness of the trash. Ideally, one ton of trash may be dried in thirty minutes. To assist in the drying of very wet trash, a number of gas burners 86 may be externally fitted to the wall 80 of the tumbler 12.

Because the upper tumbler 12 is for the drying of trash and not for the burning thereof, a preselected amount of carbon dioxide gas or helium gas may be discharged therein to extinguish any fires that may ignite.

Once the trash is substantially dry, it passes out of the upper tumbler 12 through the trash outlet end 22 and into and through the trash transfer pipe 16 into the lower tumbler 14 via the inlet end 42 thereof.

Inside the lower tumbler 14, the trash is burned. As discussed above, the wall 54 of the lower tumbler 14 is permeable whereby oxygen-rich air may enter and heat may escape to heat the upper tumbler 12. Also because of this construction, ash and unburned material may fall out of the tumbler onto the fire tray 60.

Inside the lower tumbler 14 are axially provided trusses 88. The trusses 88 assist in tumbling the burning trash and directing it toward the outlet end 52.

The fire tray 60 is rotatably situated below the lower tumbler 14. The tray serves the dual function of reburning unburned or incompletely burned trash in one of a number of reburning bins 90 and providing combustion spaces for burning woodchips or, as an alternative possibility, used tires in one of a number of combustion bins 92. The combustion from the material placed in the combustion bins 92 may be necessary to ignite the trash in the lower tumbler 14 or to provide added drying heat to dry the trash in the upper tumbler 12. (Combustion in the tray 60 may be of a flammable gas in lieu of wood or woodchips.) The bins 90 and 92 may be pivotably mounted to provide for individual dumping of burned ash material remaining therein. The ash material may be dumped onto the ash floor 62 (shown in FIG. 1) for subsequent removal via the ash dump 64 into the pit 58 to await sanitary disposal.

Figure 3:
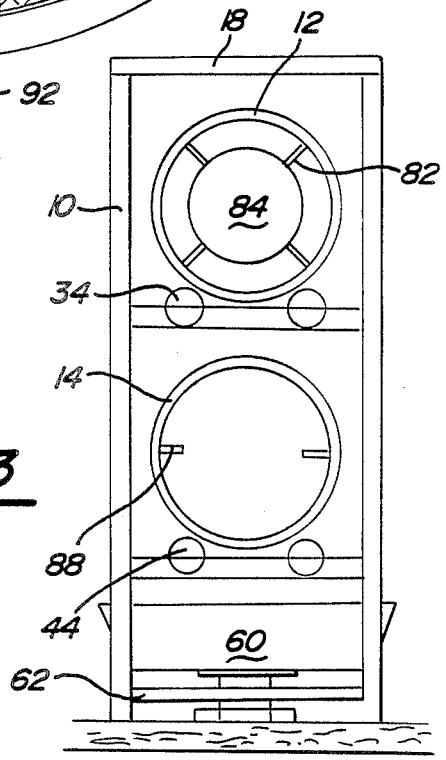
FIG. 3 is a raised elevational end view of the present invention.

Referring now to FIG. 3, a sectional end view of the present invention is illustrated. This view aids in a better understanding of the relationship of the important elements thereof.

Having described my invention, however, many modifications thereto may become apparent to those skilled in the art to which it pertains without deviation from the spirit of the invention as defined by the scope of the appended claims.

I claim:

1. An incinerator for drying then cleaning burning trash, said incinerator including:

means for drying trash until dried;

means for burning said dried trash, said means for burning being operably coupled to said means for drying; and means for filtering gases exhausted from said means for drying and said means for burning;

said means for drying comprising a tumbler having a first trash receiving end, a second trash exhausting end and means for tumbling and directing trash from said first end to said second end;

said means for tumbling comprising one or more pitch-adjustable scoops.

2. An incinerator for drying then cleaning burning trash, said incinerator including:

an upper rotating trash drying tumbler for receiving and drying trash until dried;

a lower rotating trash burning tumbler interconnected to said upper rotating drying tumbler for burning said dried trash received from said upper rotating drying tumbler; and a fire tray wherein material is burned, said tray being situated below said lower rotating trash burning tumbler;

said tray having a continuous wall peripherally situated thereabout;

said tray having a substantially planar base;

said tray being rotatable in a direction about an axis which is substantially perpendicular to the rotational axis of said lower tumbler.

3. The incinerator of claim 2 further including means for filtering gases exhausted from said upper rotating drying tumbler and said lower rotating burning tumbler.

4. The incinerator of claim 3 wherein said upper rotating trash tumbler is a drum having a first end and a second end and a peripheral wall having an inside and an outside.

5. The incinerator of claim 4 wherein said trash is received through an aperture defined in said first end and said trash is exhausted through an aperture defined in said second end.

6. The incinerator of claim 5 wherein said first end is elevated relative to said second end.

7. The incinerator of claim 6 wherein said inside of said wall has means for tumbling and directing trash from said first end to said second end as said upper rotating trash tumbler is turned.

8. The incinerator of claim 7 wherein said means for tumbling and directing comprises one or more scoops fixed axially to said inside of said wall and one or more disks fixed radially between said one or more scoops.

9. The incinerator of claim 8 further including means for adjusting the pitch of said one or more disks.

10. The incinerator of claim 3 wherein said lower rotating trash burning tumbler is a drum having a first end and a second end and a peripheral wall having an inside and an outside.

11. The incinerator of claim 10 wherein said wall is composed of a metal mesh.

12. The incinerator of claim 10 wherein said dried trash is received through an aperture defined in said second end and is exhausted through an aperture defined in said first end.

13. The incinerator of claim 10 wherein said second end is elevated relative to said first end.

14. The incinerator of claim 13 wherein said inside of said wall has means for tumbling and directing said trash from said second end to said first end.

15. The incinerator of claim 14 wherein said means for tumbling and directing comprises one or more trusses fixed axially to said inside of said wall.

16. The incinerator of claim 3 further including a fire tray wherein material is burned said tray being situated below said lower rotating trash burning tumbler.

17. An incinerator for drying then cleaning burning trash, said incinerator including:

an upper rotating trash drying tumbler for receiving and drying trash until dried;

a lower rotating trash burning tumbler interconnected to said upper rotating drying tumbler for burning said dried trash received from said upper rotating drying tumbler;

means for filtering gases exhausted from said upper rotating drying tumbler and said lower rotating burning tumbler; and a fire tray wherein material is burned, said tray being situated below said lower rotating trash burning tumbler;

said fire tray including a plurality of individually dumpable sections.

18. The incinerator of claim 17 wherein said material is a gas.

19. The incinerator of claim 17 wherein said material is wood.

20. The incinerator of claim 17 wherein said material is incompletely burned trash removed from said lower rotating trash burning tumbler.

21. A method of drying then cleaning burning trash in the incinerator having an upper rotating trash drying tumbler in communication with a lower rotating trash burning tumbler, said method including the steps of:

delivering trash into the upper rotating trash drying tumbler;

drying said trash delivered into said upper rotating trash drying tumbler until dried;

transferring said dried trash from said upper rotating trash drying tumbler into said lower rotating trash burning tumbler;

burning material within a fire tray situated below said lower rotating trash burning tumbler for causing burning of said trash within said lower tumbler; and reburning trash not completely burned in said burning step by placing said unburned trash in said fire tray.

22. The method of claim 21 including the step of filtering gases produced from the drying and burning of said trash.

23. The method of claim 21 including the step of rotating said fire tray.

* * * * *